US005482011A

United States Patent [19]

Falck

[11] Patent Number: 5,482,011

[45] Date of Patent: Jan. 9, 1996

[54] FOUR-CYCLE INTERNAL COMBUSTION ENGINE HAVING A ROTATING CYLINDER SLEEVE

[75] Inventor: Giorgio E. Falck, Milan, Italy

[73] Assignee: FIN.G.E.F. S.r.l., Milan, Italy

[21] Appl. No.: 268,171

[22] Filed: Jun. 29, 1994

[30] Foreign Application Priority Data

Jul. 19, 1993 [IT] Italy ..... MI93A1587

[51] Int. Cl.[6] ..... F01L 7/00

[52] U.S. Cl. ..... 123/80 C

[58] Field of Search ..... 123/80 C

[56] References Cited

U.S. PATENT DOCUMENTS

| | | | |
|---|---|---|---|
| 1,188,297 | 6/1916 | Meyer | 123/80 C |
| 1,198,007 | 9/1916 | Chivvis | 123/80 C |
| 1,267,787 | 5/1918 | Nance | 123/80 C |
| 1,271,137 | 7/1918 | Davison | 123/80 C |
| 1,711,781 | 5/1929 | Gibson et al. | 123/80 C |
| 5,315,963 | 5/1994 | Warf | 123/80 C |

FOREIGN PATENT DOCUMENTS

| | | | |
|---|---|---|---|
| 0016381 | 3/1980 | European Pat. Off. . | |
| 652181 | 4/1928 | France . | |
| 55-014983 | 7/1978 | Japan . | |
| 191216 | 1/1923 | United Kingdom | 123/80 C |
| 2129488 | 9/1982 | United Kingdom . | |

*Primary Examiner*—Noah P. Kamen
*Attorney, Agent, or Firm*—Collard & Roe

[57] ABSTRACT

A four-cycle internal combustion engine having a crankshaft, a spark plug with a central electrode and a piston cylinder with an internal surface. An intake opening and an exhaust opening are formed in the internal surface. A sleeve is rotatably disposed adjacent the internal surface. A port is formed within the sleeve and is configured and positioned to sequentially coincide with the intake opening and the exhaust opening. The piston reciprocates within the sleeve and overlaps the port at the top dead center position of the piston. Conical gears on the bottom of the sleeve and on the crankshaft rotate the sleeve at one half the speed of the crankshaft to realize the four cycles of the engine.

11 Claims, 4 Drawing Sheets

INTAKE

COMPRESSION

EXPANSION (EXPLOSION)

EXHAUST

Rotatory Skirt

FOUR-CYCLE INTERNAL COMBUSTION ENGINE HAVING A ROTATING CYLINDER SLEEVE

BACKGROUND OF THE INVENTION

1. Field of the Invention

This invention relates to an "Otto" or a "Diesel"-cycle four-stroke internal combustion engine, having one or more cylinders in any orientation. The engine is designed and structured as to be of very simple construction. The engine is capable of delivering a specific power and higher number of revolutions than prior art engines with the same cylinder capacity. The weight and cost of the engine is remarkably lower and has the advantage of lower emissions.

2. The Prior Art

As is known, the present mechanical engineering for internal combustion engines provides substantially for two types of engines, namely four-stroke engines and two-stroke engines, utilizing either the Otto or the Diesel cycle.

It is also known that four-stroke engines have many and great advantages relative to the two-stroke engine. Actually, gasoline four-stroke engines have a higher thermodynamical yield, clean emissions, lower fuel consumption and run quieter compared to two-stroke engines which utilizes a gasoline-oil mixture. All these advantages involve a greater mechanical complexity, which in practice brings about an increase in weight and higher costs.

Two-stroke engines, on the contrary, have only the advantage of being structurally simpler and of delivering greater power than is delivered by four-stroke valve engines. This is due to the fact that two-stroke engines—with the same r.p.m.s.—have twice as many active phases, i.e. explosions. The application field of two-stroke engines is substantially limited to low displacement engines, where technical simplicity, low cost and low weight prevail. Four-stroke engines, usually the multi-cylinder ones, are largely used for applications that require high power, such as motor cars, transport motor vehicles, racing cars, and in all those cases where cost, mechanical complexity and weight are largely justified by the performances of these engines.

Attempts have been made to reduce the mechanical complexity and the weight of four-stroke valve engines. However, these attempts have brought about technically and practically acceptable results, such as to justify their utilization instead of the traditional two-stroke engines.

On the other hand, the mechanical-structural complexity of four-stroke engines, however improved, for instance through the adoption of head camshafts in order to eliminate tappets, is still practically unchanged. This is due to the fact that said mechanical complexity lies especially in the complex kinematic chain which constitutes the so-called "timing system", i.e. a system consisting of two or more head valves for each cylinder, crankshafts for driving the valves either directly or through tappets, the geared kinematic chains or toothed belts which transfer the motion of the driving shaft to the crankshafts, which, in their turn, control the valves according to prefixed intervention phases to carry out the opening-closing cycle of the valves of each cylinder.

It is also well known that today internal combustion engines ("Otto" cycle, either utilizing gasoline or diesel), have the drawback of high emissions and, therefore, noxious exhaust gases, as fuel combustion is always incomplete due to the impossibility of obtaining, with the present structures of these engines, a perfect mixing in the combustion chamber between fuel and combustion supporter (oxygen from air). To obtain a perfect mix between fuel and oxygen, a mixing on a molecular level should be achieved in each space of the combustion chamber according to substantially stoichiometric ratios.

In other words, it would be necessary to cause a powerful vortical motion of the components of the mix, which cannot be achieved because of the very short time in which the mixing takes place; besides, even the vortical motion of the components of the mix, caused by the shiftings of the piston, is never sufficient to allow a perfect mixing, especially in a Diesel-cycle; this is due to the fact that movement of the piston causes vortexes of the combustion components which are always substantially axially orientated relatively to the piston skirt, which contrasts sharply with what is well known, i.e. that to obtain an ideal vortex, its axis should always be obliquely orientated relatively to the shifting direction of the members that generate the vortex. At present, in an effort to reduce air pollution caused by exhaust gases of today's engines, expensive special fuels or expensive and heavy catalytic silencers are used.

There arises, therefore, the problem of providing a one- or multi-cylinder four-stroke engine, so designed as to sharply reduce the mechanical complexity and, therefore, also the weight and cost of four-stroke engines with two or more pairs of valves per cylinder.

SUMMARY OF THE INVENTION

The main object of this invention is to provide an internal combustion four-stroke engine to improve the timing systems, to reduce the weight and cost of the engine, and to achieve a quieter, more fuel-efficient and smaller engine.

A further object of the invention is to provide an engine with a single structure and compact enough to be mechanically comparable to a two-stroke engine.

Still a further object of this invention is to provide a reliable four-stroke engine which allows the delivery of a greater power and r.p.m.s. with equivalent displacement compared with four-stroke valve engines. The engine also has emissions with a very low content of unburned polluting substances.

These and still further objects, which shall be more clearly disclosed by the following description, are achieved by a four-stroke internal combustion engine, with one or more cylinders however orientated, wherein the piston skirt of each cylinder is separated from the latter and rotates in touch with the internal surface of said cylinder, without axial translation, at a speed equal to half the speed of the engine crankshaft. At least one port or window is provided on said rotatory skirt, such port or window being so sized and located as to be caused to coincide, during the rotation, with analogous intake and exhaust openings correspondingly provided in said cylinder. The rotation of said skirt being achieved by drive gearing means placed between said crankshaft and the lower end of said skirt so as to allow, through the continuous rotation of said skirt at half the speed of the crankshaft, the realization of the four phases of the four-stroke cycle.

More particularly, to allow the rotation of the skirt, such drive gearing means preferably consist of a couple of conical gears, one of which is coaxially integral with the peripheral end of the skirt, and the other one is coaxially keyed onto the crankshaft which alternately drives the cylinder pistons. Besides achieving a rotation speed of the skirt equal to half the speed of the crankshaft, the number of gear teeth integral with the skirt, in case of use of a conical couple, is twice the number of teeth of the gearing integral with the crankshaft. Similarly, with a kinematic chain with more than two gears, the same half speed will be achieved with a 1:2 ratio between the number of teeth of the drive gear and the number of teeth of the skirt gear.

Further still, to achieve the correct realization of the four phases of the cycle (intake-compression-combustion and exhaust), the intake and exhaust ports have preferably a rectangular shape or another shape, and are arranged approximately 90° relative to one another. The width of the bent side of each port transverse to the cylinder axis is such as to subtend an angle of about 45° with the apex on the axis of the cylinder and the relevant skirt. The port provided in said rotatory skirt is also rectangular and the cross section of said port corresponds to an angle of about 45° in order to reach a perfect closing of the combustion chamber during the compression and expansion phases. In practice, the angles of the ports are slightly different from 45° to allow an anticipated intake and a delayed exhaust, such as to optimize the thermodynamic yield of the engine.

BRIEF DESCRIPTION OF THE DRAWINGS

Further characteristics and advantages of this invention will be more clearly disclosed by the following detailed description, wherein reference is made to the drawings, which are to be construed as non-limitative examples, wherein.

DETAILED DESCRIPTION OF PREFERRED EMBODIMENTS

Figure 1:
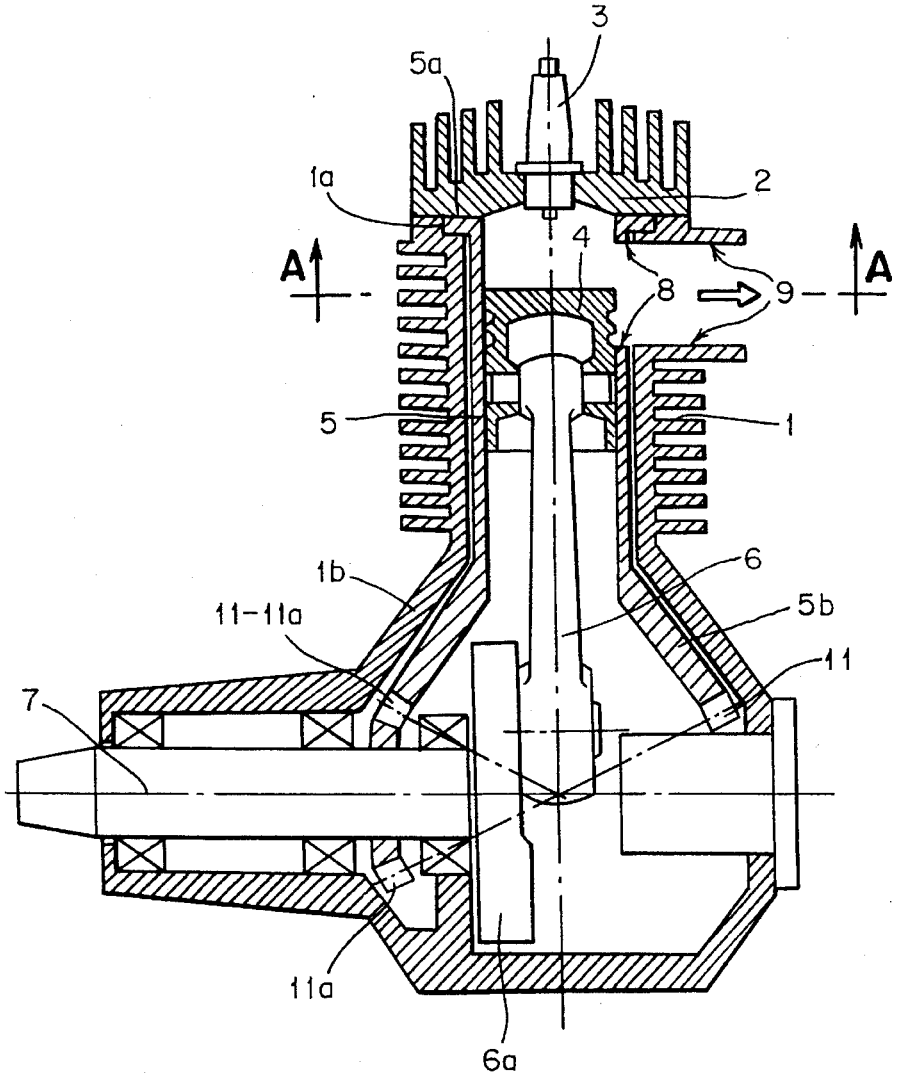
FIG. 1 is an axial-cross-sectional view of the cylinder of a four-stroke, rotatory skirt alternating engine according to this invention.
Figure 3:
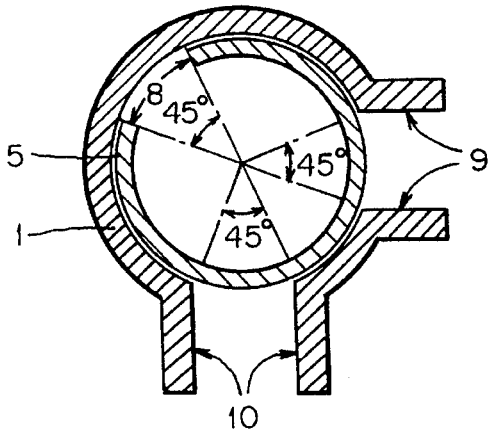
FIG. 3 is an enlarged cross-sectional view taken along the line A—A of FIG. 1.
Figure 2A:
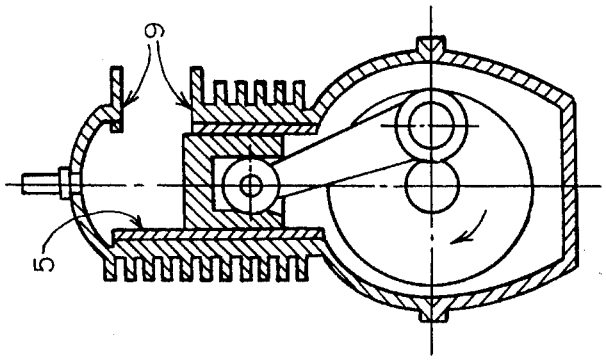
FIGS. 2A–2D and 2E–2H are respectively the axial and transverse sectional views of the same cylinder of FIG. 1, with the rotatory skirt in the positions required for the realization of the four phases of the "Otto"-cycle or the Diesel-cycle.
Figure 2B:
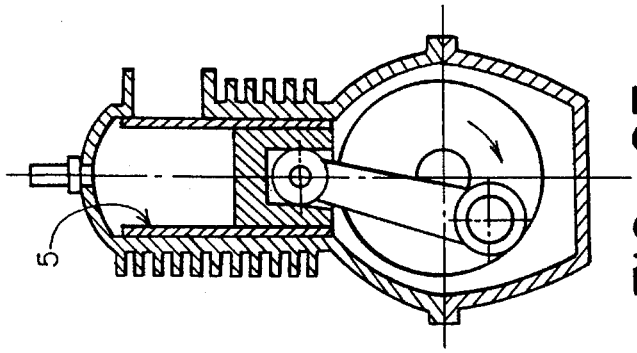
Figure 2C:
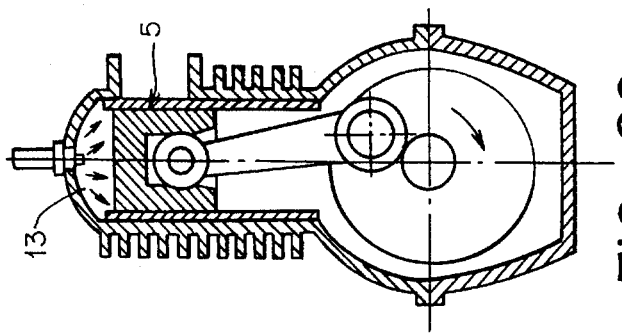
Figure 2D:
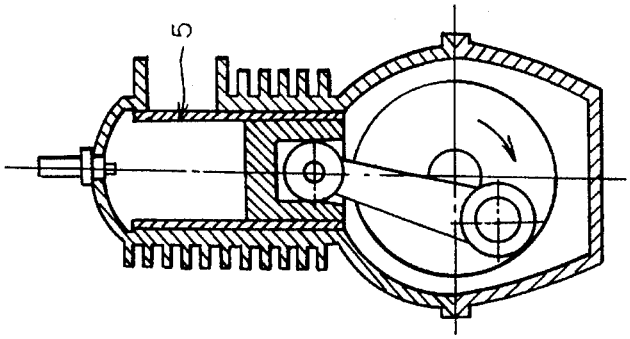
Figure 2E:
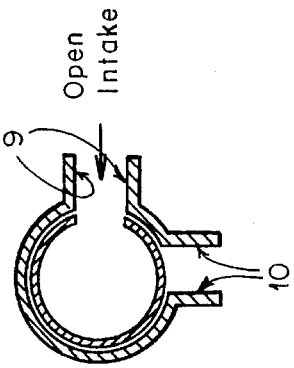
Figure 2F:
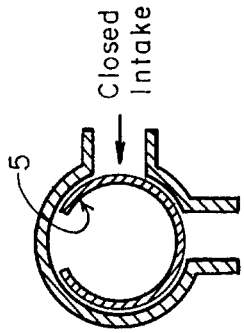
Figure 2G:
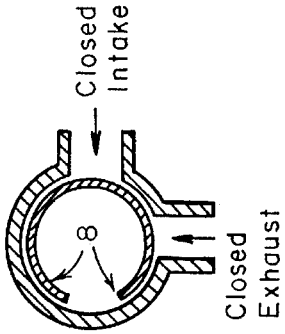
Figure 2H:
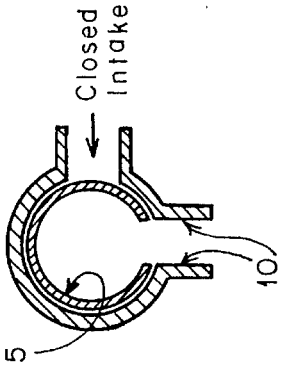

With reference to said figures, and in particular to FIGS. 1 to 3, the four-stroke internal combustion engine realized according to this invention utilizes substantially the general structure of a traditional alternating engine. The engine includes a finned cylinder 1, closed on top by a head 2 with an ignition spark plug 3 and a reciprocating piston 4 within a skirt 5 and driven by a connection rod-crank system 6, *6a*. Connection rod-crank system 6, *6a* drives a shaft 7 whose axis is perpendicular to the alternating stroke of the piston. In case of a multi-cylinder engine, the connecting rod-crank system consists of a single device, known as a crankshaft.

The four-stroke engine according to the invention involves a substantial simplification over traditional valve engines as it entirely eliminates the so-called timing system provided for the movement of the valves, that is the valves, return springs and camshafts, possible tappets, and the complex gears or toothed belt systems necessary for transmitting motion from the crankshaft to the cam shafts. Said technical simplification is achieved, according to this invention, by having piston skirt 5 separated from finned cylinder 1, causing the former to rotate within said cylinder, and in touch with the internal surface of the latter. Different oil-film lubricated metals can be utilized as well as other system such as ball bearings or the like. Said skirt 5 is provided at its upper end with a ring *5a* and at its lower end with a bell *5b*. Ring *5a* is rotationally engaged within a notch *1a*. Bell *5b* resides within a bell-shaped flaring *1b* provided on the opposite end of the cylinder. The function of ring *5a* and lower bell *5b* is that of preventing axial translations of skirt 5 within the cylinder which holds it. Bell *1b* has also another function which shall be explained further below.

A port or window 8 having a substantially quadrangular and preferably rectangular shape or section is provided in the upper part of skirt 5. The longer side of port 8 is vertically oriented and the smaller side is horizontal and perpendicular to the axis of the piston stroke. At the same height as port 8 are two corresponding ports 9 and 10 provided in cylinder 1. Each port 9 and 10 has an area which is substantially equal to the area of the skirt port so as to allow, during the rotation of the skirt relative to the fixed cylinder, a perfect coincidence between said ports.

The continuous rotation of skirt 5 is obtained by means of a couple of conical gears **11–11*a* (FIG. 1), of which gear 11 is integral with the periphery of bell *5b* and gear *11a* is keyed on to crankshaft 7**.

To allow the consecutive realization of the four phases of the cycle, skirt 5 should reach and maintain a rotation speed equal to half the speed of the crankshaft, and to this aim the number of teeth of gear 11, integral with the skirt, shall be twice the number of teeth of gear *11a* integral with shaft 7 (FIG. 11). Besides, the maximum length of the angled horizontal sides of rectangular ports 8, 9 and 10 is limited by the bore of the relevant cylinder. In fact, as FIG. 3 shows, the horizontal side of port 8 of the rotating skirt and of the fixed intake and exhaust ports 9–10 shall have in any case a length such as to subtend a maximum angle of 45° whose apex coincides with the median vertical axis of the skirt. If the angles should exceed 45°, there might arise the drawback of a partial communication between intake and exhaust during the rotation of the skirt.

The choice of the width of the skirt's port and of the intake and exhaust ports do not depend only on the size of their horizontal side, but also, and especially, on the size of the vertical side. Actually, the vertical side (indicated for the sake of clearness by "1" in FIG. 2) may also be greater—and even by far—than the horizontal side; in some cases, the length of the "1" side may arrive up to half the stroke of the cylinder or even at bottom dead center. Therefore, by a suitable design of the ports, one can maximize the intake and exhaust sections of the engine, facilitating in this way the flows of the air-fuel mix and the scavenging of exhaust gas from the combustion chamber 13. This allows a maximum number of revolutions to be attained as well as a specific power markedly higher than that which can be obtained from the present four-stroke valve engines.

As proof of the above explanation, the fact is that the advantages achieved by the rotating skirt engine with ports varying in width and number according to the utilization requirements of the engine cannot be achieved even by the engines with several pairs of head valves. This is demonstrated by the fact that in the rotary skirt engine one can obtain ports or windows whose area is equal or greater than 30% the area of the cylinder or skirt section, while in valve engines one can never provide enough valve housings to reach a total area equal to 30% of the cylinder's cross section.

A further advantage which is obtained with the engine according to the invention is that in the absence of valves, trouble with the intake and exhaust flow caused by the poppet valves is avoided. In this way, a great energy loss (only partly given back), which is necessary for the compression of the return springs of said valves, is also avoided.

The sequence of the strokes of the four-stroke cycle realized by the above-described simplified engine is clearly illustrated in FIGS. 2A–2H. For each stroke, the position of the skirt port relative to the cylinder and to the intake and exhaust ports is shown.

Figure 4:
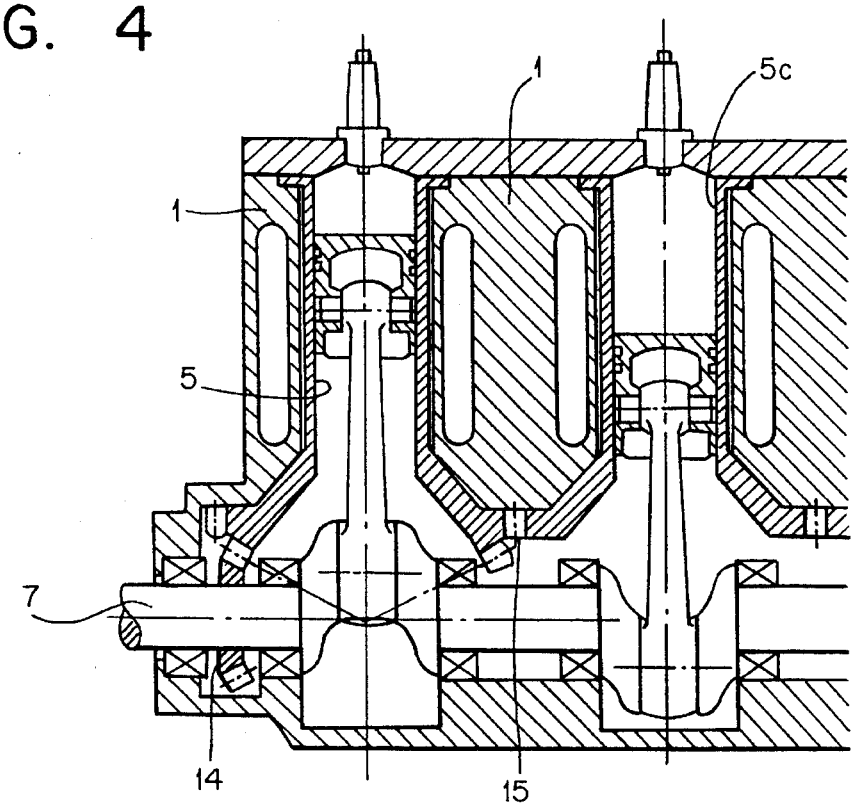
FIG. 4 is an axial cross-sectional view of part of a multi-cylinder engine utilizing the rotatory skirt cylinders according to the invention.

The simplification described with reference to FIGS. 2 and 3, relative to one only alternating piston cylinder, is also validly realized in multi-cylinder engines, as shown in FIG. 4.

In this engine, 1 indicates the cylinder block with several cylinders, whose respective rotary skirts 5, 5*c*, etc., engaged to one another, are mounted inside each of them. In this case, the "even" rotatory skirts rotate in a contrary direction relative to the "odd" ones, as only one set of conical gears 14, integral with shaft 7, is provided for the rotation of all the skirts. This involves, in practice, the alternate positioning (on the right and left sides of the cylinder block) of the intake and exhaust ports. This fact can be made up for by introducing a further gear between the horizontal gears of each adjoining couple of rotary skirts. A further solution to cause all of the skirts to rotate in the same direction is to provide each cylinder with its own conical gear, as is the case in FIG. 1.

Obviously, in practice other solutions can be provided to cause all of the skirts to rotate in the same direction. The choice of any solution is dependent especially on the construction costs and the overall allowable dimensions.

Besides, the rotary skirt of this invention can be usefully applied also in the field of small engines which are normally tow-stroke engines. In this case, the slight mechanical complication (conical couple and rotary skirt) is largely made up for by the higher thermal yield.

Figure 5:
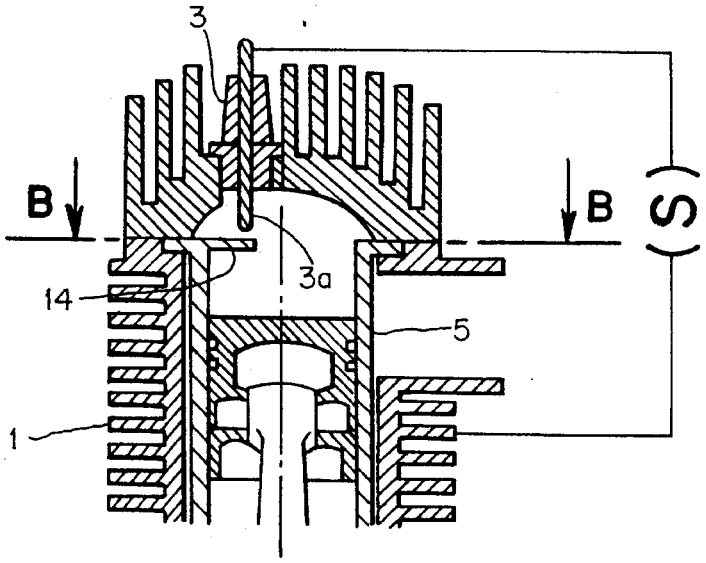
FIGS. 5 and 5A are cross sectional views of a mechanical and functional variant of the rotatory skirt engine of the preceding figures.
Figure 5A:
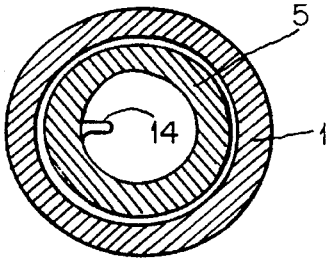

According to this invention, the continuous rotation of the skirt can be utilized to cause and synchronize the firing of spark plug 3 at each combustion phase, avoiding in this way the present complex and cumbersome system consisting of the coil ignition, platinum points and rotary contact breaker. Ignition of each cycle can, in fact, be obtained (FIGS. 5–5A) by applying to the upper end of the skirt a conducting tang 14, protruding horizontally inside the skirt, as is clearly shown by section B—B in FIG. 5 and in FIG. 5A, in such a way as to brush against the end of electrode 3*a* of plug 3 during the rotation of said skirt, the electrode being charged with "high-voltage" fed through a simple coil.

The distance between the plug electrode when it is brushed against and the tang will be shorter than the arc distance of the current at the electrode, so as to cause said arc to shoot out. The current may be either alternate or direct. The angular position of said tang relative to the cylinder ports can be selected to cause the spark to shoot out with a given "advance" relative to the upper expansion-combustion dead point.

In practice, this simple device also provides the advantage of reducing pollution. In fact, thanks to the smooth running of the engine (due to the absence of springs to be compressed), one can adjust the dimensions of the tang and the electrode, causing an abundant current flow to pass, which causes in its turn the electric power of the spark plug to surpass the power dispersed through friction when the engine is idling or neutral. In this case, the idling or neutral engine can run on pure electric current, with no fuel consumption. In this way, in idle and neutral conditions, there would be no pollution at all. One would have, therefore, a no-pollution spark and piston electric engine in idle and neutral conditions, and a traditional internal combustion cycle in all the other cases.

The technical simplicity of this rotary skirt engine may find a useful application also in the field of micro-engines for models and similar utilizations, with the great advantage of eliminating the usual incandescence glow plugs for the ignition. The usual costly fuel mixes necessary to avoid combustion advances (knocks) would no longer be required.

Figure 6:
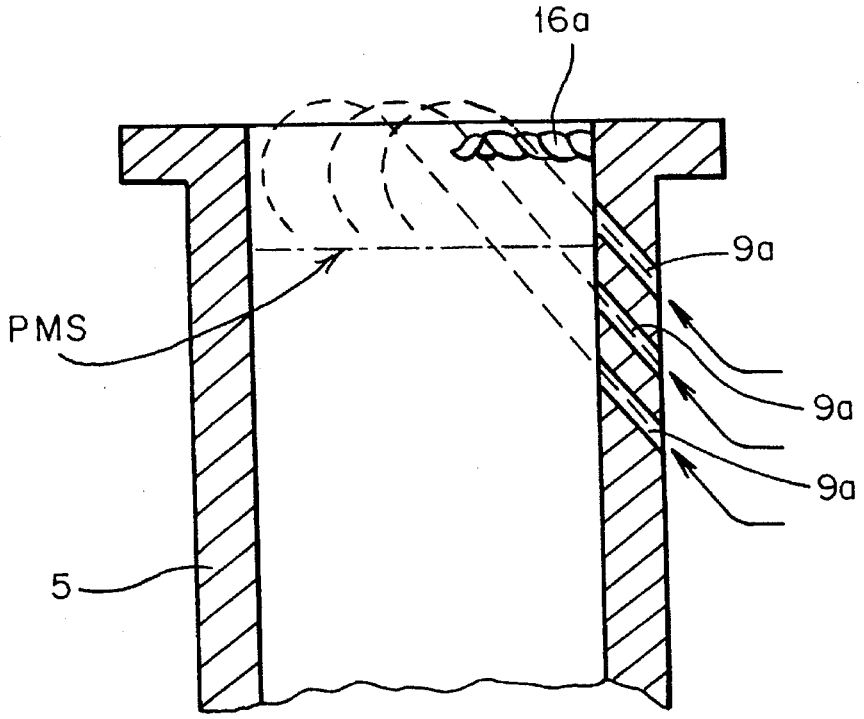
FIGS. 6 and 6A are a cross sectional view and a top view, respectively, of still another embodiment.
Figure 6A:
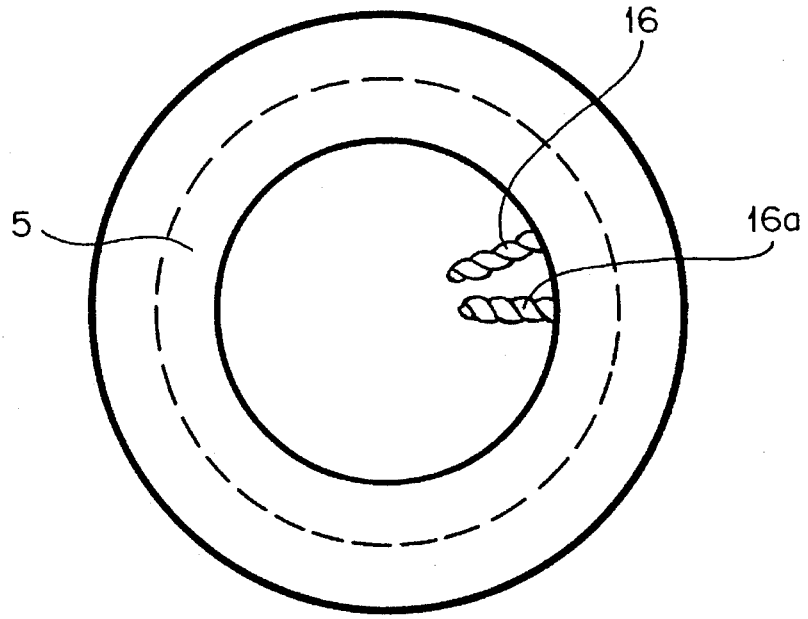

In conclusion, this rotary skirt engine can be utilized for gasoline-oil mix engines without the aforementioned complications. According to the invention, the utilization of the rotary skirt allows an optimal mixing of fuel and oxygen from intake air, reducing drastically the pollution caused by exhaust gases. This result is achieved, both in the case of one-cylinder engines and in the case of multi-cylinder engines, by providing above the upper dead point UDC (FIG. 6) one or several fins or protruding elements 16–16*a*, etc., shaped as helical blades like those of fan wheels or the like, which come out horizontally from the internal wall of the rotary skirt 5 and are radially oriented. Said blade or blades 16–16*a* are located above the intake openings 9 provided in the rotary skirts, so as to allow, possibly in combination with more intake openings 9–9*a* (FIG. 6) inclined upwards, the creation in the combustion chamber of an acceleration of the vortex of the intake mix created by the rotary skirt, together with an upwards inclination of said vortex, optimizing in this way the mixing.

In all of the afore-mentioned embodiments, oil circulation is provided between said cylinder and the respective rotary skirt. The oil is delivered by the usual oil pump through coil channels or the like, provided in the cylinder wall. Lastly, from the above disclosure, one clearly understands that further modifications and mechanically and functionally equivalent variants may be introduced without exceeding the protection scope of the invention.

I claim:

1. A four-cycle internal combustion engine having a crankshaft, a spark plug with a central electrode and a piston cylinder with an internal surface, a radial and an axial direction, an intake opening and an exhaust opening, the engine comprising:

a sleeve rotatably disposed adjacent the internal surface of the cylinder, said sleeve being restricted against movement in the axial direction, said sleeve having a top end and a spaced opposite bottom end;

a port formed within said sleeve configured and positioned to sequentially coincide with the intake opening and the exhaust opening;

a conducting element on said top end of said sleeve extending radially inwardly to brush against the central electrode of the spark plug to initiate combustion, wherein said conducting element is positioned to provide proper ignition advance relative to the top dead center position of the piston;

gear means on said bottom end of said sleeve and on the crankshaft, wherein said gear means rotates said sleeve at one-half the speed of the crankshaft to realize the four cycles of the engine.

2. A four-cycle internal combustion engine having a crankshaft, a spark plug with a central electrode and a piston cylinder with an internal surface, a radial and an axial direction, an intake opening and an exhaust opening, the engine comprising:

a sleeve rotatably disposed adjacent the internal surface of the cylinder, said sleeve being restricted against movement in the axial direction, said sleeve having a top end and a spaced opposite bottom end;

a port formed within said sleeve configured and positioned to sequentially coincide with the intake opening and the exhaust opening;

a partially helical blade on said top end of said sleeve above the top dead center position of the piston and above said port, said blade extending radially inwardly to mix the gases entering from the intake opening;

gear means on said bottom end of said sleeve and on the crankshaft, wherein said gear means rotates said sleeve at one-half the speed of the crankshaft to realize the four cycles of the engine.

3. A four-cycle internal combustion engine having a crankshaft, a spark plug with a central electrode and a piston cylinder with an internal surface, a radial and an axial direction, an intake opening and an exhaust opening, the engine comprising:

a sleeve rotatably disposed adjacent the internal surface of the cylinder, said sleeve having a top end and a spaced opposite bottom end;

a port formed within said sleeve configured and positioned to sequentially coincide with the intake opening and the exhaust opening;

the piston reciprocating within said sleeve and overlapping the port at the top dead center position of the piston;

a partially helical blade on said top end of said sleeve above the top dead center position of the piston and above the port, said blade extending radially inwardly to mix the gases entering from the intake opening; and gear means on said bottom end of said sleeve and on the crankshaft, wherein said gear means rotates said sleeve at one-half the speed of the crankshaft to realize the four cycles of the engine.

4. A four-cycle internal combustion engine having a crankshaft, a spark plug with a central electrode and a piston cylinder with an internal surface, a radial and an axial direction, an intake opening and an exhaust opening, the engine comprising:

a sleeve rotatably disposed adjacent the internal surface of the cylinder, said sleeve having a top end and a spaced opposite bottom end;

a port formed within said sleeve configured and positioned to sequentially coincide with the intake opening and the exhaust opening, wherein the port comprises several upwardly-angled apertures to form an oblique vortex with the engine gases to reduce emissions in the exhaust gases;

the piston reciprocating within said sleeve and overlapping the port at the top dead center position of the piston; and gear means on said bottom end of said sleeve and on the crankshaft, wherein said gear means rotates said sleeve at one-half the speed of the crankshaft to realize the four cycles of the engine.

5. A four-cycle internal combustion engine having a crankshaft, a spark plug with a central electrode and a piston cylinder with an internal surface, a radial and an axial direction, an intake opening and an exhaust opening, the engine comprising:

a sleeve rotatably disposed adjacent the internal surface of the cylinder, said sleeve having a top end and a spaced opposite bottom end;

a port formed within said sleeve configured and positioned to sequentially coincide with the intake opening and the exhaust opening;

the piston reciprocating within said sleeve and overlapping the port at the top dead center position of the piston;

a conducting element on said top end of said sleeve and extending radially inwardly to brush against the central electrode of the spark plug to initiate combustion, wherein said conducting element is positioned to provide proper ignition advance relative to the top dead center position of the piston; and gear means on said bottom end of said sleeve and on the crankshaft, wherein said gear means rotates said sleeve at one-half the speed of the crankshaft to realize the four cycles of the engine.

6. The four-cycle internal combustion engine of claim 5, wherein said gear means comprises:

a first conical gear integrally formed with said sleeve and concentrically arranged on said sleeve; and a second conical gear integrally formed with the crankshaft.

7. The four-cycle internal combustion engine of claim 6, comprising an additional piston cylinder with an additional sleeve and additional gear means, said additional gear means comprising an additional conical gear integrally formed on said additional sleeve for engaging said first conical gear.

8. The four-cycle internal combustion engine of claim 6 comprising:

an additional piston cylinder with an additional sleeve and additional gear means;

said additional gear means comprising an additional conical gear integrally formed on said additional sleeve and a further gear engaging said first conical gear and said additional conical gear so that said sleeve and said additional sleeve rotate in the same direction.

9. The four-cycle internal combustion engine of claim 6, wherein said first conical gear has twice as many teeth as said second conical gear so that said sleeve rotates at one-half the speed of the crankshaft.

10. The four-cycle internal combustion engine of claim 5, wherein the port has a substantially rectangular shape with two horizontal sides disposed generally transverse to the axial direction and subtending a 45° angle centered on a central axis of the cylinder;

wherein each of the intake and exhaust openings having a substantially rectangular shape with two horizontal sides subtending a 45° angle centered on the central axis.

11. The four-cycle internal combustion engine of claim 5, wherein the four-cycle internal engine is a micro-engine for models.

* * * * *